United States Patent [19]

Brückner et al.

[11] 4,279,038

[45] Jul. 21, 1981

[54] HEADPROTECTOR MADE OF ELASTIC MATERIAL FOR ATHLETES

[75] Inventors: Georg F. Brückner; Bernd Geike, both of Berlin; Bernd-Jürgen Schoen, Grafenau; Fritz Berger, Ottobeuren, all of Fed. Rep. of Germany

[73] Assignee: Metzeler Schaum GmbH, Memmingen, Fed. Rep. of Germany

[21] Appl. No.: 90,981

[22] Filed: Nov. 5, 1979

[30] Foreign Application Priority Data

Nov. 3, 1978 [DE] Fed. Rep. of Germany ..... 2847869

[51] Int. Cl.[3] ..... A63B 71/10

[52] U.S. Cl. ..... 2/425; 2/417

[58] Field of Search ..... 2/425, 410, 411, 412, 2/423, 424, 9, 205, 417, 418, 419, 420

[56] References Cited

U.S. PATENT DOCUMENTS

| | | | |
|---|---|---|---|
| 1,887,636 | 11/1932 | Hamby | 2/425 |
| 3,274,612 | 9/1966 | Merriam | 2/425 X |
| 3,992,722 | 11/1976 | Rhee | 2/425 X |
| 4,068,323 | 1/1978 | Gwon | 2/425 X |

*Primary Examiner*—Peter P. Nerbun

*Attorney, Agent, or Firm*—Herbert L. Lerner; Laurence A. Greenberg

[57] ABSTRACT

Headprotector for athletes, including a body of form-molded polyurethane integral foam surrounding the head on all sides, extending to the beginning of the neck vertebrae on the back of the head, and having a bowl-shaped region covering the chin, the molded body having openings formed therein for the eyes, nose, mouth and ears, a parting slot extending from the mouth opening over the chin bowl, and two parallel longitudinal slots extending over the occipital region of the head and ending at the lower edge of the molded body forming a free strap therebetween, the free strap extending from the upper region of the molded body to the beginning of the neck vertebrae.

6 Claims, 3 Drawing Figures

HEADPROTECTOR MADE OF ELASTIC MATERIAL FOR ATHLETES

BACKGROUND OF THE INVENTION

The invention relates to a headprotector made of elastic material for athletes, with portions covering at least the forehead, temples, ears and malar bone.

A headprotector of this kind made of leather, which may be filled with an elastic material has been known for a long time for use in boxing. This protector, however, covers the temples, ears, forehead, and partly covers the malar bone, but provides no protection for the occipital part of the head. A further disadvantage thereof is that the leather absorbs perspiration during training to such an extent that it must be dried thereafter for long periods of time, and thus becomes unusable after a relatively short time.

For other types of sports, such as Karate for example, such a headprotector made of Latex-foam is known. This headprotector is surfaced with an elastic paint by a dipping process. Besides the relatively bad fit of this headprotection, which easily slides out of position or which applies pressure to the head if secured by a strap at the back of the neck, the durability of such a protector made of Latex-foam is very short, such as when used for full contact Karate, for example. Once tears appear, it is not practical to repair them or cement them together again.

Other energy absorbing flexible helmets are disclosed in U.S. Pat. Nos. 3,934,271 and 3,992,722. The latter patent, for example, describes a headprotector consisting of a unitary formed member of polyurethane foam. However, this device also includes an outer layer which uses somewhat different polyurethane foam than that which is the subject of the invention of the instant application, as will be discussed hereinbelow.

The headprotector disclosed in the hereinafore-mentioned patent, comprises a basket or cage which is practically completely closed, and which is relatively rigidly, and in any case fixedly, closed by cross-pieces in the chin and mouth regions. Furthermore, the previously known headprotector does not provide sufficient protection in the sensitive occipital region at the back of the head, but is only provided there with a narrow strap. A head protector of this type can hardly be fitted to different head sizes, because it does not yield in the chin region. Therefore, either a poor fit must be tolerated, or several different sizes must be carried in stock. Furthermore, there is the danger of injuries to the back of the head.

It is accordingly an object of the invention to provide a headprotector made of elastic material for athletes, which overcomes the hereinafore mentioned disadvantages of the heretofore known devices of this general type, and which assures extensive protection of the head in sports in which collisions, hitting, or impact injuries, such as bruises, hemorhages or bone fractures are regularly to be expected. Furthermore, it is an object of the invention to make the headprotector of such material, and in such a form that it easily fits any particular head shape, and beyond this that is so durable that tears or breaks of the material cannot occur even at extremely high stresses. Additionally, it is an object of the invention to provide a headprotector which is easily adapted to different sizes and provides reliable protection in the occipital region of the head.

BRIEF SUMMARY OF THE INVENTION

With the foregoing and other objects in view there is provided, in accordance with the invention, a headprotector for athletes, comprising a one-piece body of form-molded soft, fully elastic polyurethane integral foam surrounding the head on all sides, extending to the beginning of the neck vertebrae on the back of the head, and having a bowl-shaped region covering the chin, the molded body having openings formed therein for the eyes, nose, mouth and ears, a parting slot extending from the mouth opening over the chin bowl, and two parallel longitudinal slots extending over the occipital region of the head and ending at the lower edge of the molded body forming a free strap therebetween, the free strap extending from the upper region of the molded body to the beginning of the neck vertebrae.

It is furthermore advantageous if the upper part of the headprotector is shaped like a helmet and provided with four symmetrical openings, and has a lesser thickness than the adjacent vertical protective zones. In particular, the headprotector is additionally reinforced in the forehead, temples, malar bone and occipital regions.

In accordance with another feature of the invention, there is provided a bur-type fastener extending from one part of the chin bowl to another part of the bowl across the parting slot.

In accordance with a further feature of the invention, there is provided a bur-type fastener extending from one part of the occipital region of the molded body to another part of the occipital region across the two parallel longitudinal slots and the free strap. These fasteners provide a secure holding or seating for any head size.

In accordance with an additional feature of the invention, the molded body has an inner surface having a beveled edge formed thereon at the edge of the ear openings for the outer ear, to avoid a feeling of pressure on the ears.

In accordance with an additional feature of the invention, the molded body has a surface having a beveled edge formed thereon at the edge of the openings in vicinity of the forehead and malar bone. The chamfer or bevel at the eye opening near the forehead is approximately 45° and at the malar bone, 30°. The finished form molded foam part may also be covered by a lacquer dip.

In accordance with a concomitant feature of the invention, the molded body has an inner surface having a groove formed therein which is horizontal above the eye opening and vertical along the cheeks, for perspiration run off.

Through the construction of the headprotector according to the invention, the protector is virtually subdivided into three portions, two side portions and one upper portion, which are flexible with respect to each other, but elastically connected with each other. In this way the head protector can be relied upon to closely follow the contour of the head of the wearer, and thereby provide protection. The portions which reach the back of the head and the free strap supply a reliable protection for the back of the head under all circumstances. The use of the polyurethane-Integral foam results in greater durability of the headprotector, which is rather strongly stressed or bent in certain areas when it is put on or taken off.

Other features which are considered as characteristic for the invention are set forth in the appended claims.

Although the invention is illustrated and described herein as embodied in headprotector made of elastic material for athletes, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DETAILED DESCRIPTION OF THE INVENTION

Figure 1:
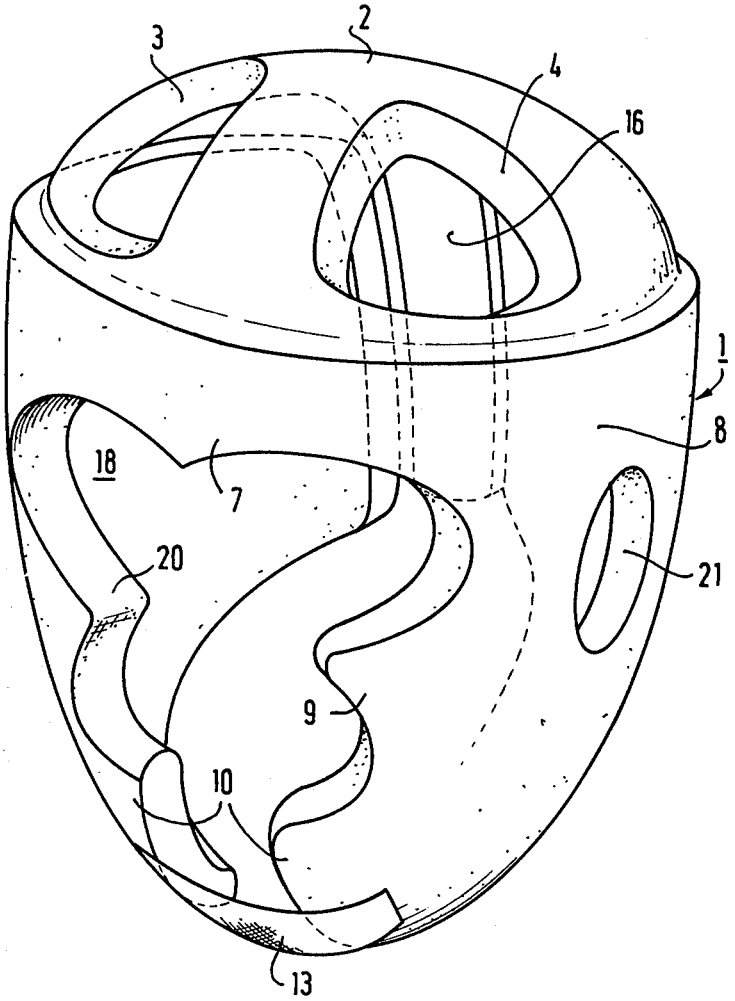
FIG. 1 is a diagrammatic perspective view of the headprotector or helmet of the invention, as seen from the side and top.
Figure 2:
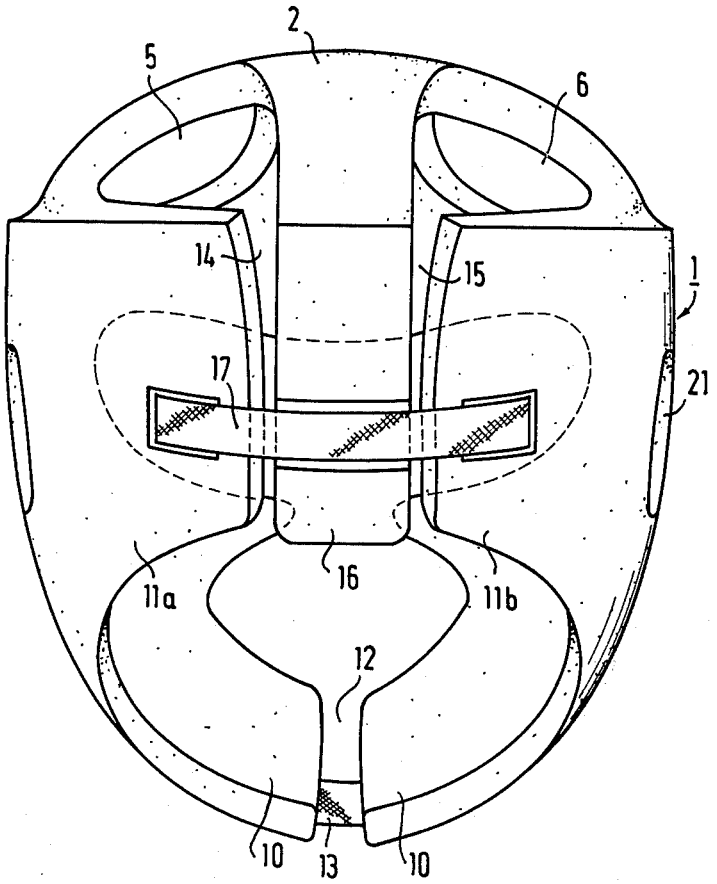
FIG. 2 is a diagrammatic perspective view of the headprotector or helmet of FIG. 1, as seen from the back.
Figure 3:
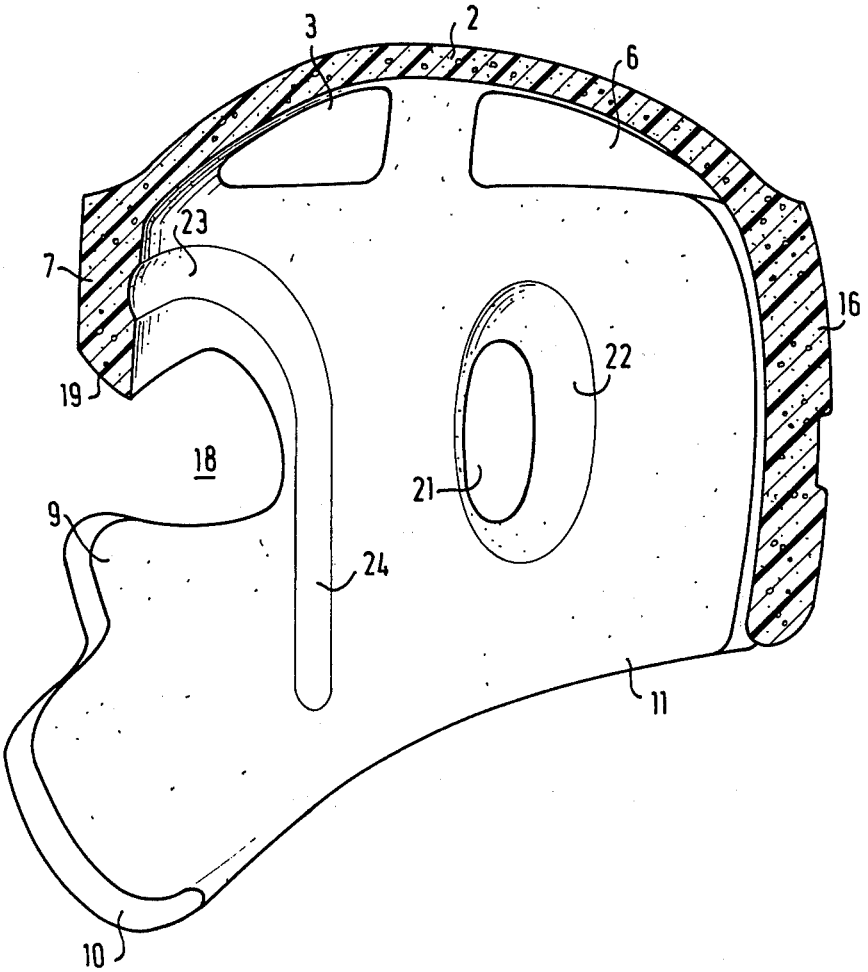
FIG. 3 is a longitudinal section taken through a perspective view of the helmet, showing the inner surface thereof.

Referring now more particularly to all of the figures of the drawing as a whole, it is seen that the headpart is an integral, foamed formbody 1, made from a model head to assure a good fit. The helmet-like thinner upper part 2 has four approximately triangular openings 3, 4, 5 and 6, and continues into the adjacent reinforced frontal part 7, the region 8 which covers the temples, the malar bone parts 9 and the bowl 10 which almost completely covers the chin and the lower jaw and extends obliquely upward and back into the occipital protection 11 shown in FIGS. 2 and 3. To facilitate putting on the headprotector and to obtain a better fit for a particular head size, the chin bowl 10 is parted by a vertical slot 12, which is best seen in FIG. 2. The sides of the bowl 10 forming the slot 12 are connected with each other by a self-adhesive bur-type fastener 13, such as a separable hook and loop type fastener made of nylon or other materials. Such fasteners may be obtained from Velcro, Inc. of New Hampshire which markets such products under the trademark VELCRO. Two vertical slots 14 and 15 are provided in the occipital part 11 in such a manner that a free, elastic strap 16 is formed from the center of the helmet-like upper part 2 extending downward and reaching practically to the neck vertebrae. This assures on one hand, the elastic fit to the shape of the head, and on the other hand provides safe protection of the occipital region. The two rear side occipital headprotector portions 11*a* and 11*b*, and the strap 16 can also be connected to each other by a self-adhesive bur-type fastener 17.

To exclude an obstruction of vision by the helmet to a great extent, the approximately oval opening 18 for the field of view is chamfered at the upper frontal edge 19 by approximately 45°, and at the side and malar bone edges 20 by approximately 30°.

At the side of the headprotector 1 there are provided openings 21 for hearing, which are surrounded by additional recesses 22 formed on the inner surface of the head protector for the outer ear, so that no acoustic difficulties are encountered, and no pressure from the headprotector in the ear regions is felt.

Furthermore, above the eye-opening 18 at the inner surface of the frontal part 7 a groove 23 is formed. The groove 23 first runs horizontally and then continues into downwardly leading channels 24 which serve for draining the perspiration coming from the forehead, and therefore doesn't allow perspiration from the forehead to reach the eyes.

The advantage of the headprotector according to the invention is essentially that the head is securely protected at all endangered areas from the harmful effects of hitting, punching and falling, so that the danger of an injury is reduced, if not completely eliminated. Beyond this, the adjustment of the headprotector for fitting any particular head size is made very simple, and the field of view is free of disturbing obstructions in all directions because of the chamfered edges.

The essential advantage is the use of a soft Polyurethane-Integral-Foam material for the formed part. This integral foam has an almost completely closed surface skin which forms an outer zone of higher density during the foaming process, and which continues into the cellular core like a sandwich. In this way, the uniform molecular polymerization in the process results in an extremely high elasticity. During deformation and impact, respectively, the kinetic energy is absorbed by the Polyurethane-Integral-Foam, which completely returns to its original shape once the stresses are removed. This is caused by the fact that an air cushion breaking effect occurs due to the closed cell structure and the randomly oriented cell walls. The air cushion effect guarantees the absorption of hits and optimal spring action, i.e. return spring. The massive skin of the sandwich-like molded part which continues into the cellular core is generated from the same foam material in one operation when the part is formed.

As an additional protection, the head protector can be subsequently covered with an elastic lacquer in order to achieve the optimal appearance.

There is claimed:

1. Headprotector for athletes, comprising a soft and elastic one-piece uncoated seamless body of form-molded polyurethane integral foam surrounding the head on all sides, extending to the beginning of the neck vertebrae on the back of the head, and having a bowl-shaped region covering the chin, said molded body having openings formed therein for the eyes, nose, mouth and ears, parting slot means for size adjustment extending from said mouth opening over said chin bowl, and two parallel longitudinal slots extending over the occipital region of the head and ending at the lower edge of said molded body forming a free strap therebetween, said free strap extending from the upper region of the molded body to the beginning of the neck vertebrae.

2. Headprotector according to claim 1, including a bur-type fastener extending from one part of said chin bowl to another part of said bowl across said parting slot.

3. Headprotector according to claim 1 or 2, including a bur-type fastener extending from one part of said occipital region of said molded body to another part of said occipital region across said two parallel longitudinal slots and said free strap.

4. Headprotector according to claim 1, wherein said molded body has an inner surface having a beveled edge formed thereon at the edge of said ear openings for the outer ear.

5. Headprotector according to claim 1, wherein said molded body has a surface having a beveled edge formed thereon at the edge of said openings in vicinity of the forehead and malar bone.

6. Headprotector according to claim 1, wherein said molded body has an inner surface having a groove formed therein which is horizontal above said eye opening and vertical along the cheeks, for perspiration run off.

* * * * *